166-250
9/30/80 OR SR 4,224,988

United States Patent [19]

Gibson et al.

[11] 4,224,988

[45] Sep. 30, 1980

[54] DEVICE FOR AND METHOD OF SENSING CONDITIONS IN A WELL BORE

[75] Inventors: Joseph T. Gibson; Gerald L. Duhon, both of New Iberia, La.

[73] Assignee: A. C. Co., New Iberia, La.

[21] Appl. No.: 921,317

[22] Filed: Jul. 3, 1978

[51] Int. Cl.[2] ..... E21B 47/04; G01N 9/24

[52] U.S. Cl. ..... 166/250; 166/53; 166/65 R; 166/66; 166/75 R; 175/41; 73/155

[58] Field of Search ..... 175/41, 48, 66, 24, 175/38; 166/53, 247, 250, 65 R, 66; 250/254, 256, 269, 434, 435; 73/155

[56] References Cited

U.S. PATENT DOCUMENTS

| | | | |
|---|---|---|---|
| 2,658,724 | 11/1953 | Arps | 250/254 |
| 2,832,566 | 4/1958 | Bielstein | 73/155 X |
| 3,115,576 | 12/1963 | Rickard | 175/41 X |
| 3,324,717 | 6/1967 | Brooks et al. | 175/48 X |
| 3,334,226 | 8/1967 | Buck | 250/356 X |
| 3,529,153 | 9/1970 | Zimmerman et al. | 250/71.5 R X |
| 3,827,295 | 8/1974 | Rochon et al. | 73/155 |
| 3,839,914 | 10/1974 | Modisette et al. | 73/155 X |

*Primary Examiner*—Stephen J. Novosad
*Attorney, Agent, or Firm*—Guy E. Matthews

[57] ABSTRACT

A device for and method of sensing conditions in a well bore by positioning a radioactive source adjacent the surface of the well bore for emitting a radioactive signal across the well bore. A means for detecting the radioactive signal is positioned opposite the radioactive source and electrical means are mounted with the detecting means for electrically measuring the intensity and frequency of occurrence of each detected signal. An electrical signal is provided by the electrical means for indicating the presence or absence of drilling fluids and/or the density of such fluids at the surface of the well bore.

25 Claims, 4 Drawing Figures

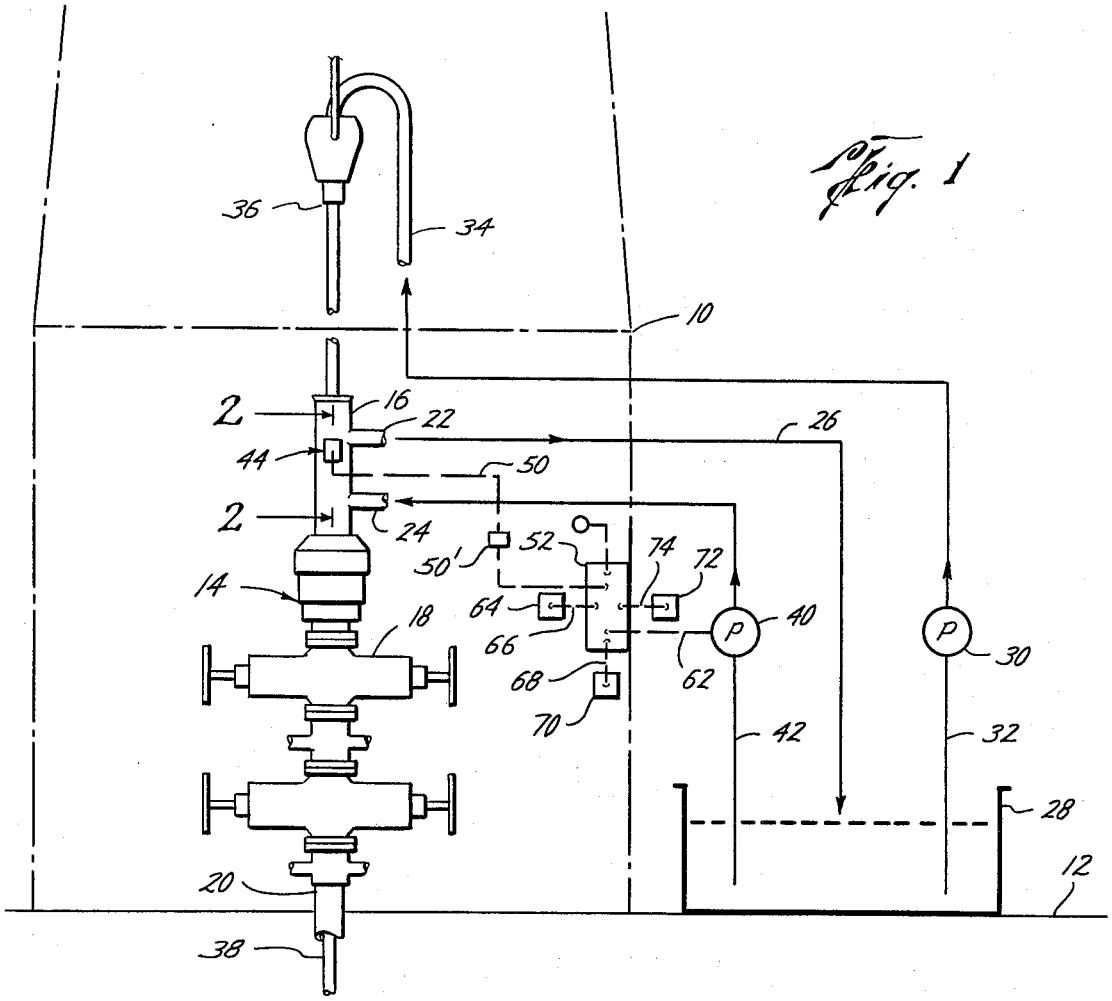
Fig. 1
Fig. 2
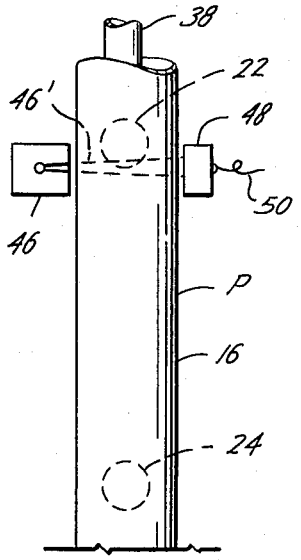
Fig. 3
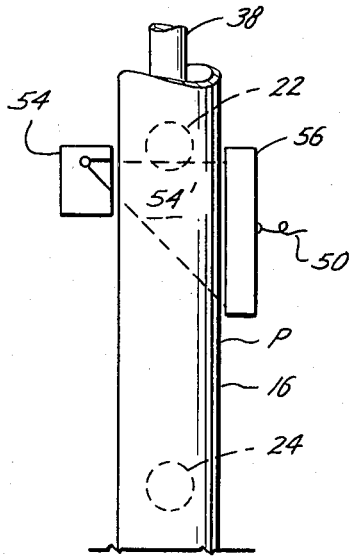
Fig. 4
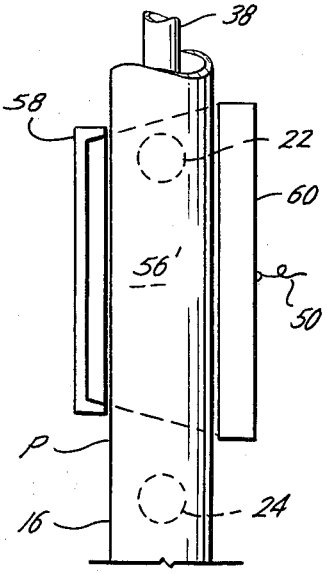

DEVICE FOR AND METHOD OF SENSING CONDITIONS IN A WELL BORE

BACKGROUND AND BRIEF SUMMARY OF THE INVENTION

The importance of determining certain conditions in a well bore are well known. For example, it is important that the drilling fluids or drilling mud used during drilling operations continually circulate through the system at a given density or weight.

It is important to know the density of the drilling fluids used. When the density is below that desired, a blowout of the well may occur because formation gases are mixed with the drilling fluid. When the density of the mud is above that desired, the efficiency of the drilling operation becomes impaired because of the undesired, unnecessary mud weight.

Further, if the drilling fluids or mud is flowing out into formations, the well is said to be taking a "drink" because of lost circulation. This condition is extremely important because loss of circulating fluid reduces the hydrostatic head in the well bore which increases the probability of a blowout.

The prior art is representatively disclosed by U.S. Pat. Nos. 3,532,502, 2,229,986, 3,550,696, 3,740,739 3,613,806, 3,833,076, 3,384,175, 2,674,695, and 2,323,128, all of which discloses inventions relating to measuring levels of fluids or drilling mud systems.

In accordance with the invention, a device for and method of sensing conditions across a well bore is disclosed which includes a radioactive source positioned adjacent the surface of the well bore to emit a radioactive signal across the well bore, a detection means for detecting the signal after transmission through fluids in the well bore, electrical means for amplifying the detected signal, and means for actuating suitable mud pumps to add drilling fluid as desired, and means for actuating alarm systems, if desired to indicate the absence of drilling fluids.

BRIEF DESCRIPTION OF THE DRAWINGS

Other objects and advantages of the invention will become apparent upon reading the following detailed description and upon reference to the drawings, in which like reference characters are used throughout to designate like parts:

FIG. 1 is a fragmentary schematic view of an exemplary embodiment of a device constructed according to the present invention;

FIG. 2 is an enlarged fragmentary view of an embodiment which may be used in the invention shown in FIG. 1;

FIG. 3 is an enlarged fragmentary view of another embodiment which may be used in the invention shown in FIG. 1; and FIG. 4 is an enlarged fragmentary view of a third embodiment which may be used in the invention shown in FIG. 1.

While the invention will be described on connection with exemplary embodiments and procedures, it will be understood that it is not intended to limit the invention to those embodiments and procedures. On the contrary, it is intended to cover all alternatives, modifications, and equivalents as may be included within the spirit and scope of the invention as defined by the appended claims.

PREFERRED EMBODIMENT

Turning first to the exemplary embodiment shown in FIG. 1, there is partially shown a typical drilling rig 10, in dotted outline, mounted on ground or surface 12. A wellhead structure illustrated at 14 includes a bell nipple 16 mounted on a blowout preventer stack 18, which is mounted on conventional casing 20. Bell nipple 16 includes a passage P in communication with the well bore, as is well known, fluid outlet or mud return line 22 communicating with the passage P for removing the drilling fluids or muds from the bore hole and a fill inlet or mud fill line 24 communicating with the passage P for adding drilling fluids to the well bore from the mud.

As is well known, during normal drilling operations drilling fluids including drilling mud flow out of the return outlet 22 illustrated by the lined arrow 26 to mud or fluid reservoir 28 which normally supplies and holds the necessary amount of drilling fluids for the well during drilling operations. A pump 30 is used to transfer and transmit drilling mud and fluids through return line illustrated by the arrows in line 32 through flexible conduit 34, the kelly 36, through the drilling string or pipe 38, through the bottom of the well bore, and outwardly through the drilling bit (not shown) for circulation back through the well bore and out through outlet 22, line 26, and back into the reservoir 28.

As is well known, the drilling fluids take the size of the well bore to prevent unwanted blowouts and the like; however, a quantity of the drilling fluids and drilling mud is constantly being used from the reservoir 28. It is also known that sometimes the drilling mud will flow outwardly into a porous formation which may cause the drilling system to lose a great quantity of drilling mud, and it is also well known that if the formation surrounding the well bore is gaseous, the gas will mix with the drilling mud to therefore greatly change the density or "mud weight" of the drilling fluids which thereby increases the danger of blowouts due to the change in drilling fluid density.

As further illustrated in FIG. 1, an additional alternate pump 40 is provided for transferring fluid to the inlet 24 for additional pumping of fluids into the well bore, if needed.

Additionally, it is also well known that if the density of the drilling fluid changes as set forth hereinabove or if the drilling fluids are being lost into the formation, it is desirable to add further drilling fluids to the drilling fluid system or to change the density and the like of the drilling fluids by adding further drilling fluids or changing the chemical composition of the fluids as desired.

As illustrated in FIG. 1 and further illustrated in FIGS. 2, 3, and 4 as will be set forth hereinafter, a source of gamma radiation is used to continuously measure the density, percentage solids, and mass of flow materials out the return line 22 utilizing a beam of gamma radiation with the source positioned below the return line and having a suitable detector 44 located below the bell nipple 16. The magnitude of the radiation reaching the detector 44 is inversely related to material density, and current developed in the detector which is directly proportional to the detected radiation is amplified and sent through suitable instrumentation as will be set forth hereinafter to determine the density of the materials, the percentage of solids and/or mass flow of materials immediately adjacent the return line 22. The detector 44 may be a high sensitivity ion chamber, and both the source and detector 44 may be purchased from Nuclear-Chicago Corporation and/or the Texas Nuclear Division of Ramsey Engineering Company.

As illustrated in FIG. 2, a source 46 is a collimated beam point source 46' such that the beam is of narrow width so that any fluid level below the narrow width beam will not be detected. Thus, the narrow beam span is used only to measure a desired preset level for presence of fluid in the casing 16, which preset level would typically or normally be at or just below the level of the flow line exit 22.

A suitable electrical conductor 50 is mounted with the ionization chamber or Guiger-Mueller tube to compare the signal from the detector with a preset electronic signal to directly indicate the presence or absence of drilling fluid across the narrow beam. Since the absence of drilling mud would be lack of radiation adsorption, the signal from detector 48 would be lower than if there were solids and the like for radiation absorption. Thus, a lowered radiation signal could be electronically mounted with pumps 40 as set forth hereinafter to automatically actuate the pump to inject fluids into the well bore through the inlet 24. As illustrated in FIGS. 3 and 4, two different type continuous nuclear sources 54 and 58 are detected by nuclear level detectors 56 and 60. Each of the sources is a typical gamma ray source such as Cesium 137 which is mounted around the casing or pipe 16 to extend radiation beams 54' and 56' adjacent or over the mud return line 22. As illustrated, the width of each of the beam 54 and 56 is used to determine the fluid level or mud level over a wide span and generates an electrical signal in relation to the level of the mud. Each of the sources 54 and 58 is designed to give a wider beam commonly known as the continuous strip type source of a typical Texas nuclear unit type CNH. The receiving sensors or detectors 56 and 60 can be the ionization chamber or Guiger-Mueller type that are longer in width or as wide in width as desired to measure the span for determining the mud level.

As illustrated in FIG. 1, electrical conduit 50 is connected with electrical metering and readout means 52 which electrically indicates the intensity and frequency of the current of each detected signal from the detectors 44 such as for example with the point source device of FIG. 2 upon a proper reading indicating an absence of drilling fluid, electrical conduit 62 mounted with the measuring and electrical means 52 automatically activating electrical pump 40 for withdrawing fluids from the fluid reservoir 28 through conduits 42 and into inlet 24 to add drilling fluids into the well bore.

A suitable electrical means such as a crystal oscillator 50' as included to generate a steady electrical frequency output rather than depending on unwanted line frequency fluctuation. It should further be noted that all electrical readout means, such as meters set forth hereinbelow are connected in parallel so that the voltage output across each terminal is the same.

A suitable density indicating means 64 is mounted through conduit 66 with the electrical means 52 for determining the density of the drilling fluids indicated by the source detectors 44, 48, 56 and 60 to determine whether or not the density of the drilling fluids or mud is the density so desired. In addition, it should be understood that a suitable recorder 72 is provided for receiving a detected signal and is connected by electrical conduit 74 to the electrical metering and readout means 52. In addition, suitable alarms 70 may be mounted with electrical means 52 as illustrated by electrical wire conductors 68 for indicating the presence of absence of drilling fluids or a dramatic drop in the drilling fluid level or a dramatic increase or decrease in the density of the drilling fluids as desired.

From the foregoing, it will be understood that this invention is one adapted to attain all the ends and objects hereinabove set forth together with other advantages which are obvious and which are inherent to the apparatus.

It will be understood that certain features and subcombinations are of utility and may be employed with reference to other features and subcombinations that are contemplated by and are within the scope of the claims.

As many possible embodiments may be made of the invention without departing from the scope thereof, it is to be understood that all matter herein set forth or shown in the accompanying drawings is to be interpreted as illustrative of the preferred embodiments, but not in a limiting sense.

We claim:

1. Means for continuously monitoring drilling fluids in a well bore adjacent the drilling fluid return-line comprising:

a continuous radiative source mounted adjacent the return line to emit a radioactive signal across the well bore;

means for detecting said radioactive signal being positioned opposite said source and wherein the magnitude of any detected signals is inversely related to the density of the drilling fluids;

electrical conduit means mounted with said detecting means for electrically transmitting any detected signals indicating the density of such drilling fluids;

metering means mounted with said electrical means for indicating the presence or absence of drilling fluids, and if such drilling fluids are present, for indicating the density of such drilling fluids; and a pump mounted with said electrical means for adding drilling fluids to the well bore, said pump being activated when the absence of drilling fluids at the surface of the well bore is indicated by said electrical signal.

2. The device as set forth in claim 1 wherein said detecting means is elongated for receiving radiation along a preset elevation span, said radioactive source emits the radioactive signal over the span and said electrical means measures the intensity and frequency of occurrence of each detected signal over the span.

3. The device as set forth in claim 2 including recording means mounted with said electrical means for providing a continuous record of the condition sensed by said detecting means, said recording means being activated by said electrical signal in response to the intensity and frequency of the detected signal to thereby provide a record of the drilling operations.

4. The device as set forth in claim 1 including an alarm for alerting the drilling crew when the condition sensed by said detecting means exceeds a selected operating condition, said alarm being mounted with said electrical means for activation in response to an electrical signal emitted by said electrical means indicating when the selected operating conditions has been exceeded.

5. The device as set forth in claim 1 including recording means mounted with said electrical means for providing a continuous record of the conditions sensed by said detecting means, said recording means being activated by said electrical signal in response to the intensity and frequency of the detected signal.

6. The device as set forth in claim 1, including an alarm for alerting the drilling crew when the absence of drilling fluids is sensed by said detecting means, said alarm being mounted with said electrical conduit means for activation in response to said electrical signal.

7. The device as set forth in claim 1, including recording means mounted with said electrical means for providing a continuous record of the level of the drilling fluids in said well bore, said recording means being activated by said electrical signal in response to the intensity and frequency of the detected signal to determine the quantity of drilling fluids used during drilling operations.

8. Means for continuously monitoring drilling fluids in a well bore adjacent the drilling fluid return line comprising:

a continuous radiative source mounted adjacent the return line to emit a radioactive signal across the well bore;

means for detecting said radioactive signal being positioned opposite said source and wherein the magnitude of any detected signals is inversely related to the density of the drilling fluids;

electrical conduit means mounted with said detecting means for electrically transmitting any detected signals indicating the density of such drilling fluids;

metering means mounted with said electrical means for indicating the absence of drilling fluids, and if such drilling fluids are present, for indicating the density of such drilling fluids;

a well head structure positioned over the well bore at the surface, said well head structure defining a passage communicating with said well bore, said well head further defining an outlet communicating with said passage for removing the drilling fluids from the well bore during drilling operations and a fill inlet communicating with said passage for adding drilling fluids to the well bore, and said detecting means mounted with said well head structure for indicating when the level of the drilling fluids is beneath the outlet which indicates the loss of drilling fluid circulation.

9. The device as set forth in claim 8 wherein said structure includes a bell nipple mounted on a blowout preventor stack, said bell nipple having the outlet and a fill inlet mounted thereon, and a pump mounted with said electrical means for adding drilling fluids through said fill inlet in response to said electrical signal indicating the loss of drilling fluids circulation.

10. A method of sensing and correcting a condition of drilling fluid downhole in a well bore, comprising the steps of:

emitting a radioactive signal from a radioactive source positioned at the surface of the well bore across the well bore and a drilling pipe positioned therein;

detecting said radioactive signal with apparatus positioned opposite the radioactive source;

measuring the intensity and frequency of occurrence of each detected signal with electrical apparatus;

providing an electrical signal from said electrical apparatus indicating the presence or absence of drilling fluids at the surface of the well bore; and adding drilling fluid to said well bore in response to electrical detection of a predetermined absence of drilling fluid at the surface of said well bore.

11. The method as set forth in claim 10 including the steps of emitting a gamma ray signal from said radioactive source, mounting an ion chamber opposite said source at the surface of the well bore, and mounting a gamma ray detector with said chamber for providing an electrical signal in proportion to the intensity and frequency of occurrence of each detected signal.

12. The method as set forth in claim 11 including the steps of emitting the radioactive signal over a preset invention span, detecting said radioactive signal over the span with elongated detecting apparatus and measuring the intensity and frequency of occurrence of each detected signal over the span with the elongated detecting apparatus.

13. The method as set forth in claim 12 including the steps of recording the conditions sensed by said detecting means to provide a continuous record of the drilling operations.

14. The method as set forth in claim 10 including the steps of providing an electrical signal from said electrical apparatus indicating when a selected operating condition is exceeded and using said electrical signal to activate an alarm for alerting the drilling crew that the selected operating condition has been exceeded.

15. The method as set forth in claim 10 including the steps of using the electrical signal to activate a recording means for providing a continuous record of the condition being sensed.

16. A method of sensing and correcting a condition of drilling fluid downhole in a well bore, comprising the steps of:

emitting a radioactive signal from a radioactive source positioned at the surface of the well bore across the well bore and a drilling pipe positioned therein;

detecting said radioactive signal with apparatus positioned opposite the radioactive source;

measuring the intensity and frequency of occurrence of each detected signal with electrical apparatus;

providing an electrical signal from said electrical apparatus indicating the presence or absence of drilling fluids at the surface of the well bore;

emitting a gamma ray signal from said radioactive source, mounting an ion chamber opposite said source at the surface of the well bore, and mounting a gamma ray detector with said chamber for providing an electrical signal in proportion to the intensity and frequency of occurrence of each detected signal; and using the provided electrical signal to activate a pump when the absence of drilling fluids at the surface of the bore hole is indicated, said pump adding drilling fluids to the well bore when activated.

17. The method as set forth in claim 16 including the steps of providing an electrical signal from said electrical apparatus indicating when the level of the drilling fluids is below a selected elevation and using said electrical signal to activate an alarm for alerting the drilling crew that the drilling fluids are below the selected elevation.

18. The method as set forth in claim 16 including the steps of using the provided electrical signal to activate a recording means for providing a continuous record of the level of the drilling fluids.

19. The method as set forth in claim 18 including the steps of emitting the radioactive signal over a preset elevation span, detecting said radioactive signal over the span with elongated detecting apparatus and measuring the intensity and frequency of occurrence of each detected signal over the span with the elongated detecting apparatus.

20. The method as set forth in claim 19 including the steps of recording the level of the drilling fluids within said well bore to determine the quantity of drilling fluids used during drilling operations.

21. The method as set forth in claim 16 including the steps of providing an electrical signal from said electrical apparatus in response to the intensity of the detected signal, and using the provided electrical signal to activate density measuring apparatus to indicate the density of the drilling fluids flowing up the well bore.

22. The method as set forth in claim 21 including the steps of providing an electrical signal from said electrical apparatus indicating when the density of the drilling fluids is less than that of a selected operating condition and using said electrical signal to activate an alarm for alerting the drilling crew that the drilling fluid density is below the selected condition.

23. The method as set forth in claim 21 including the steps of using the provided electrical signal to activate a recording means for providing a continuous record of the density of the drilling fluids at the surface of the well bore.

24. The method as set forth in claim 21 including the steps of emitting the radioactive signal over a preset elevation span, detecting said radioactive signal over the span with elongated detecting apparatus and measuring the intensity and frequency of occurrence of each detected signal over the span with the elongated detecting apparatus.

25. The method as set forth in claim 16 including the steps of:

using the provided electrical signal to activate the pump when the absence of drilling fluids at the surface of the bore hole is indicated, said pump adding drilling fluids to the well bore when so activated;

providing an electrical signal from said electrical apparatus in response to the frequency of each occurrence of the detected signal;

providing an electrical signal from said electrical apparatus in response to the intensity of the detected signal; and using the provided signal to activate density measuring apparatus to indicate the density of the drilling fluids flowing up the well bore.

* * * * *